United States Patent [19]

Wilson

[11] 4,417,229

[45] Nov. 22, 1983

[54] MEANS FOR USE ON A RAILROAD TO DISTINGUISH BETWEEN TRACTION CURRENT AND SIGNAL CURRENT

[75] Inventor: H. James Wilson, La Grange, Ky.

[73] Assignee: Safetran Systems Corporation, Louisville, Ky.

[21] Appl. No.: 375,393

[22] Filed: May 6, 1982

Related U.S. Application Data

[63] Continuation-in-part of Ser. No. 197,281, Oct. 15, 1980.

[51] Int. Cl.[3] ..... B61L 21/00; G08C 19/28

[52] U.S. Cl. ..... 340/47; 246/34 B; 246/187 B; 340/658

[58] Field of Search ..... 340/47, 658; 246/34 R, 246/34 B, 187 B

[56] References Cited

U.S. PATENT DOCUMENTS

| | | | |
|---|---|---|---|
| 3,428,868 | 2/1969 | Duckitt et al. | 246/34 R |
| 3,715,669 | 2/1973 | La Forest | 246/34 B |
| 3,992,698 | 11/1976 | Sahasrabudhe et al. | 246/34 B |
| 4,065,081 | 12/1977 | Huffman et al. | 246/34 B |
| 4,222,045 | 9/1980 | Cholin | 340/658 |
| 4,320,881 | 3/1981 | Campbell | 246/34 B |

*Primary Examiner*—Glen R. Swann, III

*Attorney, Agent, or Firm*—Kinzer, Plyer, Dorn & McEachran

[57] ABSTRACT

Means for differentiating between traction current and signal current in an electrified railroad includes a first input transformer providing an input signal of the same frequency and phase as the track signal current. A second input transformer is connected to the track to provide a track signal. There are means for comparing the phase and frequency of the input signal and the track signal and means responsive to an output from the comparison means indicating a correct comparison for providing a relay driving signal.

10 Claims, 3 Drawing Figures

110V INPUT
INPUT TRANSFORMER
10
+10V REGULATOR SUPPLY
12
18
OPTOISOLATORS
20
FROM RAILS
INPUT TRANSFORMER
22
INPUT 2
POWER
INPUT 1
OUTPUT
FREQUENCY & PHASE CHECK LOGIC CIRCUIT
14
RELAY DRIVER
16
OUTPUT TRANSFORMER AND RECTIFIER
24
LINE RELAY
26

MEANS FOR USE ON A RAILROAD TO DISTINGUISH BETWEEN TRACTION CURRENT AND SIGNAL CURRENT

SUMMARY OF THE INVENTION

This application is a continuation-in-part of application Ser. No. 197,281, filed Oct. 15, 1980.

The present invention relates to track circuits for use on electrified railroads and has particular reference to a frequency and phase detection circuit which will differentiate between signal current and non-signal current in a railroad environment.

One purpose of the invention is a track circuit of the type described which compares both the frequency and phase of track signal current and signal current from a common signal source to distinguish between signal current and traction current.

Another purpose is a simply constructed reliably operable frequency and phase checking circuit of the type described which can be utilized to not only distinguish between traction current and signal current, but to distinguish between signal currents not widely differing in frequency.

Another purpose is a track circuit of the type described which can operate at very low frequencies, thereby providing long signal blocks.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

The present invention has particular application in electrified railroads for use as a means for differentiating between traction currents and signal currents. Conventionally, one device for such use is the well-known vane relay. However, the vane relay has many disadvantages, primarily operating time, size and expense.

In an electrified rail system, either of the type where power is applied through an overhead wire, which is commonly called a catenary system, or through a third rail of the type used in many subway systems, the rails are normally the negative or ground return. As it is common in such systems to use the rails to carry signal currents, there must be some means of distinguishing between traction and signal currents. Some systems use DC power and AC signalling and there are other conventional systems in which the signal currents are applied as audio frequency overlays. However, normally the audio frequency signalling currents do not operate at a frequency lower than about 157 Hz. It is obviously advantageous to have lower frequencies for the signal currents as this permits longer signal blocks. In the present invention, for example, it is possible to have the signalling frequency as low or even lower than 30 Hz.

The present invention is particularly suitable for use in electrified railroads which provide AC traction currents and in which the signal currents may not vary more than a few Hz from the traction signal frequency. For example, the present invention may be useful with a 100 Hz signalling frequency and a 60 Hz propulsion or traction system. Another example would be 50 Hz traction current and $83\frac{2}{3}$ Hz signalling current. The invention should not be limited to any particular traction or signal frequencies. Also, the invention is particularly advantageous in situations where there are a number of parallel tracks, each of which will have signal currents at slightly different frequencies, for example at 80, 90, 100, 110 and 120 Hz. In addition, in interlocking track areas, for example near stations or the like, it is necessary to have very short track circuits and the tracks, because of the interlocking nature, do not in fact prevent signal currents from one track from entering into another track. Thus, it is important to clearly distinguish between various signal frequencies in order to have precise information as to the location of every train. The present invention, with its accurate frequency and phase comparison, provides just such a device. The invention should not be limited to electrified railroads as it also has application on diesel railroads. It is known that non-signal currents do appear on the rails of diesel railroads, for example from adjacent power lines or from an adjacent electrified railroad.

Figure 1:
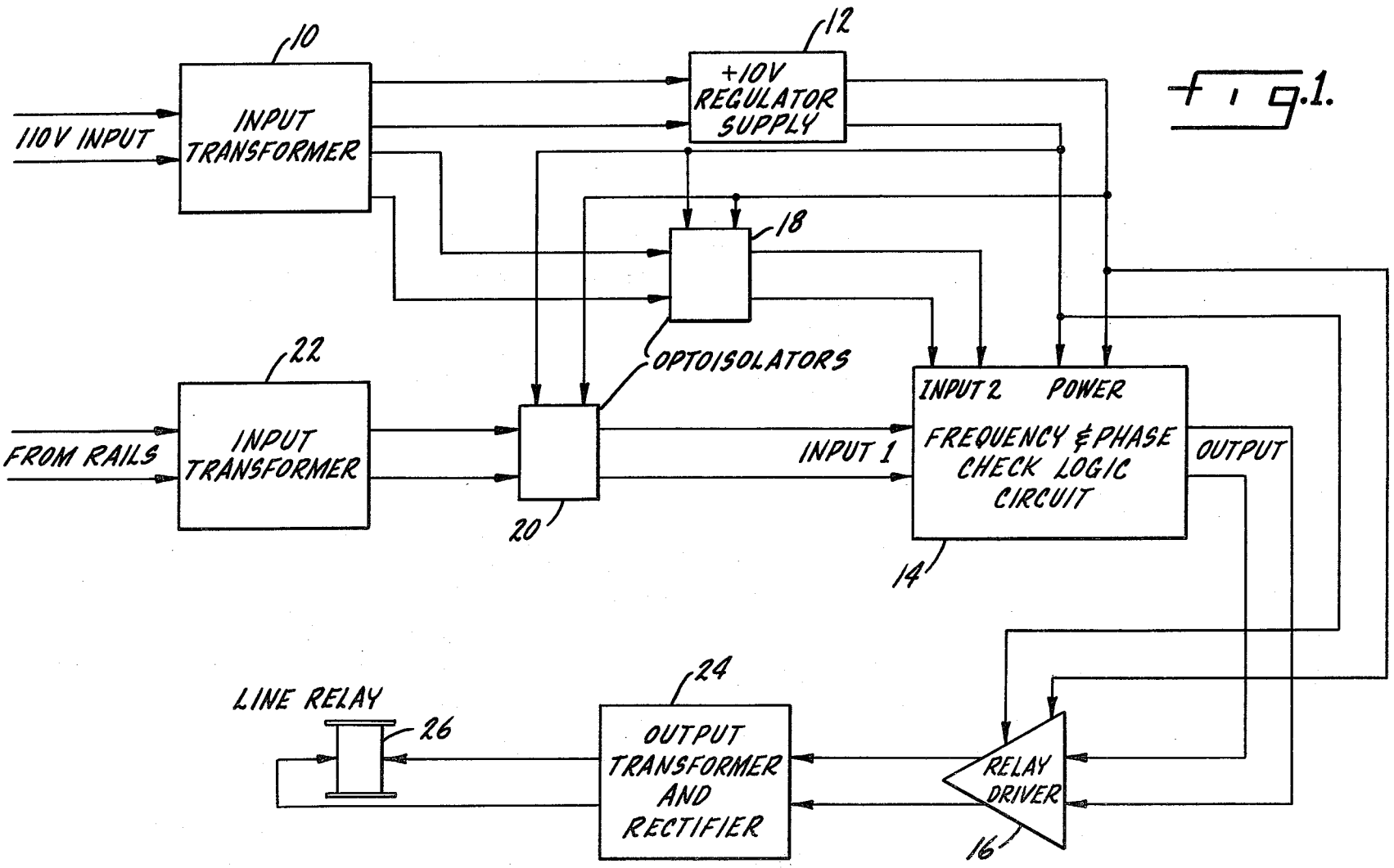
FIG. 1 is a block diagram of a track circuit of the type described.

In FIG. 1 the receiving portion of a track circuit is illustrated and an input transformer 10 will receive a 110 volt line input from the signal source. Thus, the input to transformer 10 will be signal current at the proper phase and frequency for a particular track for subsequent comparison with a detected signal from the track. Transformer 10 is connected to a voltage regulator 12 which may, for example, supply a 10 volt regulated supply to logic circuit 14, a relay driver 16, and isolation circuits 18 and 20 which may in fact be optoisolators.

A second input transformer is indicated at 22 and will be connected to the track rails to receive signal currents. The output from transformer 22 is connected through optoisolator 20 to frequency and phase check logic circuit 14 and is designated as input 1. Likewise, the second output from input transformer 10 is connected through optoisolator 18 to provide the second input for frequency and phase check logic circuit 14.

The output from logic circuit 14 is connected to relay driver 16 with the output from the relay driver being connected to an output transformer 24. Transformer 24, which may also include a rectifier, will be connected to any commonly-used line relay indicated at 26. Thus, when the circuit is functioning in the correct manner, signal current received at input transformer 22 will cause operation of line relay 26.

Figure 2:
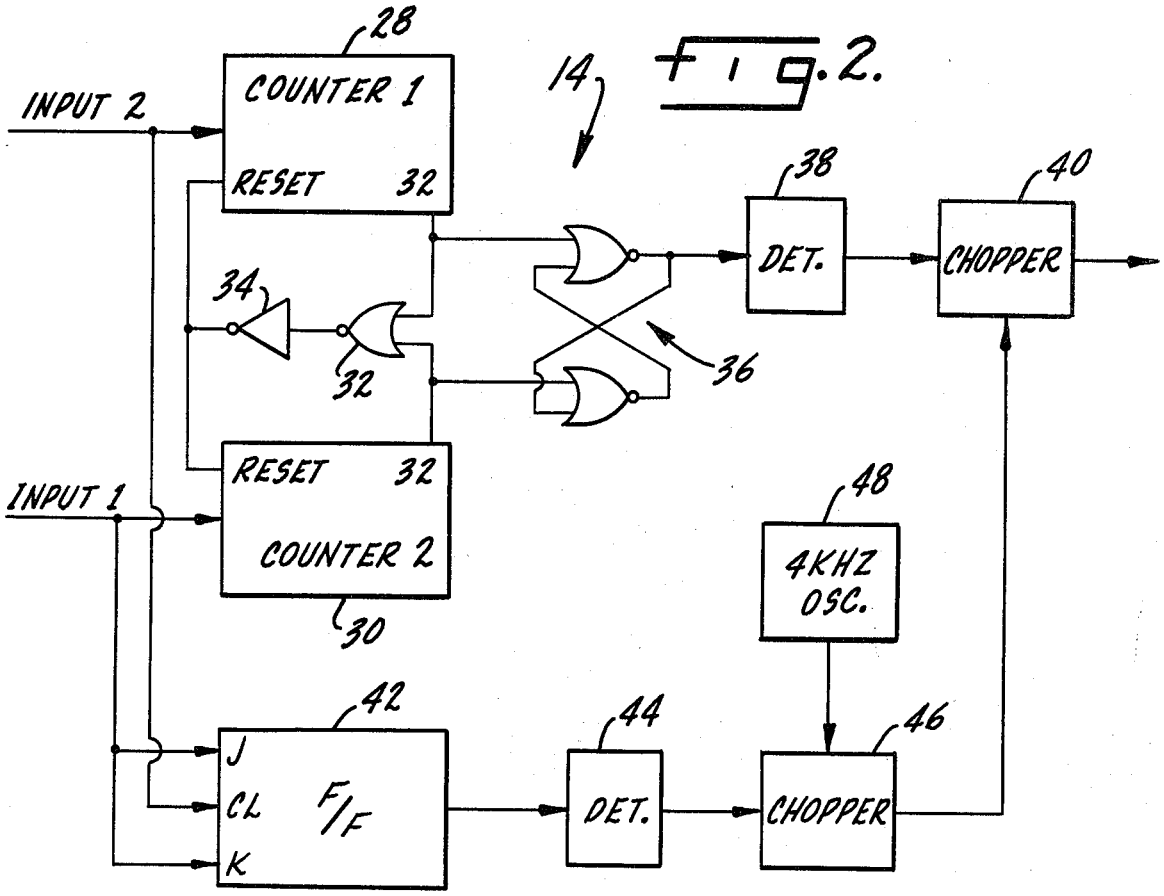
FIG. 2 is a block diagram of the frequency and phase check logic circuit.

FIG. 2 illustrates frequency and phase check logic circuit 14. Inputs 1 and 2 are each connected to a counter, designated as counters 1 and 2, and indicated at 28 and 30, respectively. Counters 1 and 2 may count up to any particular number, depending upon the accuracy requirements of the frequency comparison. As shown herein, the counters count up to 32. The outputs of counters 28 and 30 are connected to a NOR gate 32 and an inverter 34 with the output from the inverter being connected to the reset input of the counters. The outputs of the counters are also connected to a circuit configuration known as a NOR flip-flop and indicated at 36. The output of the NOR flip-flop, which will be described hereinafter is a series of pulses having a frequency of the input frequency divided by twice the count number and is connected to a detector 38 which provides a steady state DC output. The output of detector 38 is connected to a chopper 40. Detector 38 will only provide an output in response to an alternating or transitory input. Thus, a steady state input or a DC input will not activate the detector.

The 1 and 2 inputs to logic circuit 14 are also connected to a J/K flip-flop 42. Input 1 is the input to the J and K terminals and input 2 is connected to the clock terminal. The output of the J/K flip-flop, which will be described hereinafter, is connected to a detector 44 with its output being connected to a chopper 46. Detector 44, like detector 38, only provides an output in response to an alternating input. Thus, a steady state input will not activate the detector. Chopper 46 receives an input from an oscillator 48 at a convenient frequency, for example 4 KHz. The output of chopper 46 is connected to chopper 40, with the output of chopper 40 being connected to the relay driver circuit 16.

The signal provided to both of the transformers will be identical in waveform and may either be a sine wave or a series of pulses. In either event, the optoisolators which are effective to essentially isolate any ground currents from further portions of the circuitry may serve to conform the input signals to the waveform of FIG. 3. In addition, Schmitt trigger circuits may be located at the outputs of both optoisolators to further define the pulse forms provided at the inputs of the logic circuit.

Figure 3:
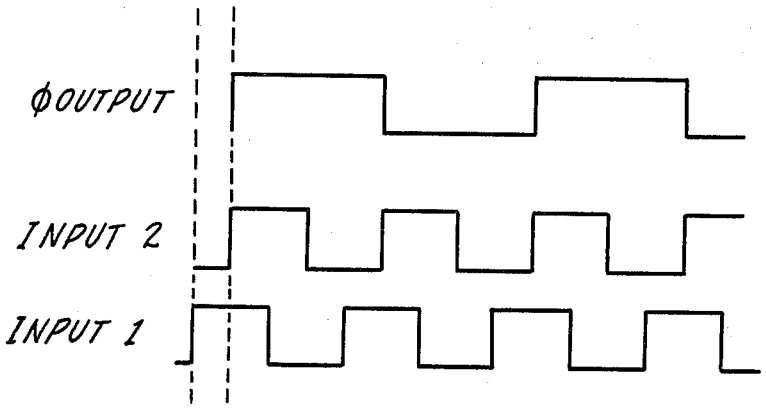
FIG. 3 is a wave diagram of a portion of the signals in the frequency and phase check logic circuit.

FIG. 3 illustrates the waveforms of the phase comparison circuit. Input 1 is connected to the J and K terminals and input 2 is connected to the clock terminal. If there is an input to the clock terminal during the period there is an input to the J and K terminals, the output will be toggled and there will be a transition at the output. Note the rise of the pulses indicated at the phase output which is in alignment with the leading edge of the pulse of input 2. Thus, every time input 1 is high and input 2 goes high, there will be an output transition. When the difference in phase between inputs 1 and 2 is at least five degrees and less than 175 degrees, there will be an output from J/K flip-flop 42 which will be a pulse train having half the frequency of the input signals. If the two inputs differ in phase by an amount less than five degrees or more than 175 degrees, within the range of operating tolerances, there will not be an output transition and thus there will be a steady state or DC output. Since detector 44 requires input transitions or alterations in input signals to provide an output, when there is the described phase relationship, there will be an input to detector 44 which will provide a steady state output. If the phase relationship varies by less than five degrees or more than 175 degrees, there will be a steady state output from J/K flip-flop 42 which in turn will not activate detector 44.

The two inputs to counters 1 and 2 are also indicated in FIG. 3. Assuming the frequencies are the same, the number 32, which is only for purposes of example, will be reached at one of the two counters slightly before the other. As soon as that number is reached, and, for example, assume it is first reached at counter 2 and caused by input 1, the output from that counter will cause the NOR flip-flop output to have a positive going transition or a high output. The output of the NOR flip-flop will stay in this condition until it is changed. Continuing with the count, because counter 2 reached the set number first, the next input pulse counted will be by counter 1. Since this counter will begin counting first, it will reach the number 32 first and it will provide an output slightly before that of counter 2. Again, both counters will be reset and the signal from counter 1 to the NOR flip-flop will cause the output to go low. The result of this continuing transition, assuming that both input signals are of the same frequency, is an output from the NOR flip-flop of a pulse train which has a frequency of the input frequency divided by twice the given number in the counters. Assuming an input of 60 Hz, the output would be a signal of slightly less than one Hz.

Since detector 38 requires an alternating input to provide an output, the continuing transition from a high to a low condition, described above, provides an input to the detector which will cause it to provide a steady state output. On the contrary, if the two inputs do not have the same frequency, or if they differ in frequency by more than about five percent, the counter having the highest frequency will always reach the set count first. This will cause the output from NOR flip-flop 36 to remain in either a high or a low condition. A steady state input to detector 38 will not result in an output from the detector. Only if the input signals to the two counters have essentially the same frequency will there be the necessary transition at the detector input to provide an output.

Detectors 38 and 44 both provide a negative DC signal at their outputs when there are transitory outputs from the J/K flip-flop 42 and NOR flip-flop 36. The negative DC signal from detector 44 will cause operation of chopper 46 which will thus provide a pulse train of 4 KHz at its output. The chopper will not function unless the proper negative bias is provided at its input. Thus, unless there is a valid phase comparison, there will be no output from chopper 46. Similarly, the negative DC output from detector 38 is applied to chopper 40. There will be no output from chopper 40 unless there is again a valid input from detector 38. The output from chopper 40 is again the 4 KHz pulse train which is received from chopper 46. In order for there to be a proper 4 KHz pulse train which is used to operate the relay driver circuit, there must be valid comparisons of both frequency and phase as described above.

Whereas the preferred form of the invention has been shown and described herein, it should be realized that there may be many modifications, substitutions and alterations thereto.

The embodiments of the invention in which an exclusive property or privilege is claimed are defined as follows:

1. Means for distinguishing between non-signal current and signal current for use on a railroad including a first input means providing an input signal of the same frequency and phase as track signal current, a second input means connected to the track to provide a track signal, means for comparing the phase and frequency of said input signal and track signal, and means responsive to said comparison means for providing a relay driving signal when the input signal and the track signal have the same phase and frequency.

2. The means of claim 1 further characterized in that said phase and frequency comparison means are separate, with an output from said comparison means requiring correspondence of both phase and frequency.

3. The means of claim 2 further characterized in that said phase comparison means includes a J/K flip-flop in which one of said input means is connected to the J and K terminals, with the other input means being connected to the clock terminal, with signals of the same providing a transitory output.

4. The means of claim 3 further characterized by and including a detector connected to the output of said J/K flip-flop, with the output of said detector being a direct current signal, with the means responsive to said comparison means including a chopper for converting said direct current signal into a signal of a predetermined frequency to provide a relay driving signal.

5. The means of claim 2 further characterized in that said frequency comparison means includes first and second counters, each connected to one of said input means and each being arranged to reset after the count reaches a set number which is the same for both counters, signals of the same frequency at the counter inputs providing a comparison output of the input frequency divided by twice the set number of said counters.

6. The means of claim 5 further characterized by and including a NOR flip-flop connected to the output of both of said counters, and a detector connected to said NOR flip-flop providing a direct current signal when there is frequency comparison.

7. The means of claim 1 further characterized by and including isolation means connected between said input means and said frequency and phase comparison means.

8. The means of claim 1 further characterized in that said first input means provides the power for said frequency and phase comparison means and means for providing a relay driving signal.

9. Means for use on an electrified railroad for sensing a selected signal current including a first input means providing an input signal of a selected predetermined phase and frequency, a second intput means connected to the track to provide a track signal, means for comparing the phase and frequency of said selected signal and said track signal, and means responsive to said comparison means for providing a relay drive signal when the input signal and the track signal have the same phase and frequency.

10. The means of claim 9 further characterized in that said phase and frequency comparison means are separate.

* * * * *